US006244365B1

(12) United States Patent
Southland

(10) Patent No.: US 6,244,365 B1
(45) Date of Patent: Jun. 12, 2001

(54) UNPLANAR NON-AXISYMMETRIC INSERTS

(75) Inventor: Stephen G. Southland, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/347,791

(22) Filed: Jul. 6, 1999

Related U.S. Application Data

(60) Provisional application No. 60/091,965, filed on Jul. 7, 1998.

(51) Int. Cl.[7] ..... E21B 10/46

(52) U.S. Cl. ..... 175/432; 175/434

(58) Field of Search ..... 175/426, 428, 175/430, 431, 432, 434

(56) References Cited

U.S. PATENT DOCUMENTS

| | | | |
|---|---|---|---|
| 4,109,737 | 8/1978 | Bovenkerk | 175/329 |
| 4,764,434 | 8/1988 | Aronsson et al. | 428/565 |
| 4,784,023 | 11/1988 | Dennis | 76/108 |
| 5,217,081 | 6/1993 | Waldenström et al. | 175/420.2 |
| 5,351,772 | 10/1994 | Smith | 175/428 |
| 5,355,969 | 10/1994 | Hardy et al. | 175/432 |
| 5,486,137 | 1/1996 | Flood et al. | 451/540 |
| 5,494,477 | 2/1996 | Flood et al. | 451/540 |
| 5,564,551 | 10/1996 | Frushour | 175/431 |
| 5,590,728 | 1/1997 | Matthias et al. | 175/432 |
| 5,598,750 | 2/1997 | Griffin et al. | 76/108.2 |
| 5,605,199 | 2/1997 | Newton | 175/432 |
| 5,611,649 | 3/1997 | Matthias | 407/118 |
| 5,617,928 | 4/1997 | Matthias et al. | 175/432 |
| 5,622,233 | 4/1997 | Griffin | 175/432 |
| 5,662,720 | 9/1997 | O'Tighearnaigh | 51/295 |
| 5,709,279 | 1/1998 | Dennis | 175/430 |
| 5,711,702 | 1/1998 | Devlin | 451/540 |
| 5,788,001 | 8/1998 | Matthias et al. | 175/432 |
| 5,871,060 | 2/1999 | Jensen et al. | 175/420.2 |
| 5,906,246 | 5/1999 | Mensa-Wilmot et al. | 175/432 |
| 5,915,486 * | 6/1999 | Portwood et al. | 175/432 |
| 5,971,087 * | 10/1999 | Chaves | 175/432 |
| 6,065,554 * | 5/2000 | Taylor et al. | 175/431 |
| 6,068,071 * | 5/2000 | Jurewicz | 175/432 |
| 6,098,730 * | 8/2000 | Scott et al. | 175/432 |

FOREIGN PATENT DOCUMENTS

| | | |
|---|---|---|
| 0 687 797 A1 | 12/1995 | (EP) . |
| 0893572A1 | 1/1999 | (EP) . |
| 2 270 493 | 3/1994 | (GB) . |
| 2 329 405 | 3/1999 | (GB) . |

* cited by examiner

*Primary Examiner*—William Neuder
(74) *Attorney, Agent, or Firm*—Christie, Parker & Hale, LLP

(57) ABSTRACT

Cutting elements for incorporation in a drill bit are provided having a body having an end face interfacing with an ultra hard material cutting layer. A main depression having a nonplanar surface is formed on the substrate and extending to the edge of the substrate subjected to the highest impact loads during drilling. This edge is immediately below the edge of the cutting layer which makes direct contact with the earth formations during drilling. The main depression is formed by forming a plurality of secondary depressions or steps such that depth of the main depression decreases in a radial direction towards the edge of the cutting element. An ultra hard material layer is bonded to the end face of the cutting element body such that the cutting layer is the thickest over the main depression. Consequently, the cutting layer edge making contact with the earth formations during drilling has an increased thickness.

37 Claims, 9 Drawing Sheets

UNPLANAR NON-AXISYMMETRIC INSERTS

This application claims the benefit of Provisional No. 60/091,965 filed Jul. 7, 1998.

FIELD OF THE INVENTION

This invention relates to cutting elements used in drag bit for drilling earth formations. Specifically this invention relates to cutting elements having a nonplanar interface including a non-uniform portion between their substrate and their cutting layer.

BACKGROUND OF THE INVENTION

A typical cutting element is shown in FIG. 1. The cutting element typically has cylindrical cemented carbide substrate body 2 having an end face or upper surface 3. An ultra hard material layer 4, such as polycrystalline diamond or polycrystalline cubic boron nitride, is bonded on to the upper surface forming a cutting layer. The cutting layer can have a flat or a curved upper surface 5.

The problem with many cutting elements is the development of cracking, spoiling, chipping and partial fracturing of the ultra hard material cutting layer at the layer's region subjected to the highest impact loads during drilling. This region is referred to herein as the "critical region". These problems are caused by the generation of peak (high magnitude) stresses imposed on the ultra hard material layer at the critical region during drilling. Because the cutting elements are typically inserted into a drag bit at a rake angle, the critical region includes a portion of the ultra hard material layer near to and including a portion of the layer's circumferential edge 6.

Another problem facing cutting elements is the delamination and/or the exfoliation of the ultra hard material layer from the substrate of the cutting element resulting in the failure of the cutter. Delamination and/or exfoliation become more prominent as the thickness of the diamond layer increases.

SUMMARY OF THE INVENTION

The present invention provides for cutting elements or inserts which are mounted in a bit body and which have an increased thickness of the ultra hard material cutting layer at their critical region, i.e., the region of the cutting element subjected to the highest impact loads during drilling. This region is generally defined beginning at the edge of the cutting element which contacts the earth formations during drilling and can span up to 50% of the cross-sectional area of the cutting element. Preferably, the critical region extends to an area between 45° and 70° on either side of the point of contact of the cutting element with the earth formation and inward to an area near the central axis of the cutting element.

A main depression is formed on the body (i.e., the substrate) end face (i.e., the upper surface) of the cutting element. The main depression is defined by multiple secondary depressions defining a main depression surface having a depth which increases in a generally stepwise fashion in an outward radial direction along a critical diameter and which decreases arcuately on either side of the critical diameter. The critical diameter is the diameter that intersects the point of contact between the edge of the cutting element and the earth formation. An ultra hard material layer is bonded to the end surface of the substrate and has either a curved or flat upper surface such that an increased thickness of the ultra hard material layer is formed over the critical region with the maximum ultra hard material thickness occurring at or proximate the edge portion or edge point of the cutting element making contact with the earth formations during drilling.

Moreover, a circumferential groove is formed on the outer surface of the body of the cutting element and spans an arc that is approximately the same as the are spanned by the critical region of the cutting element. The groove is preferably symmetric about the critical diameter of the cutting element. An ultra hard material is packed into the groove forming a secondary cutting surface for improving the cutting efficiency of the cutting element as well as delaying the erosion of the cutting element during drilling.

DETAILED DESCRIPTION OF THE INVENTION

Figure 1:
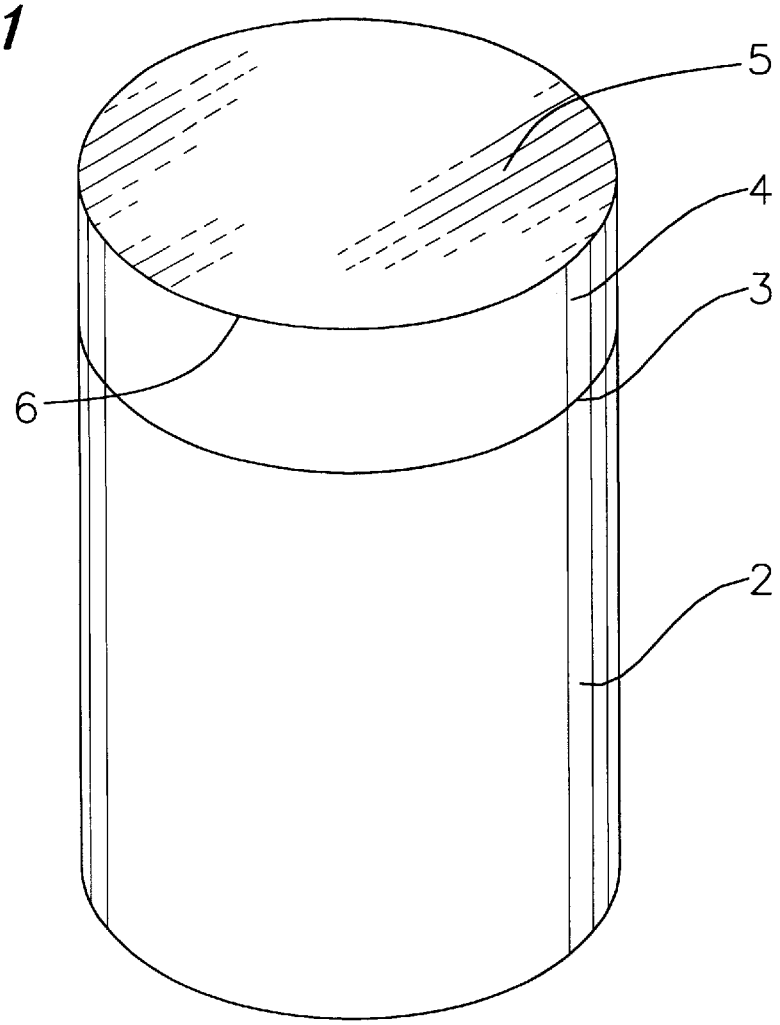
FIG. 1 is a perspective view of a conventional cutting element.
Figure 9:
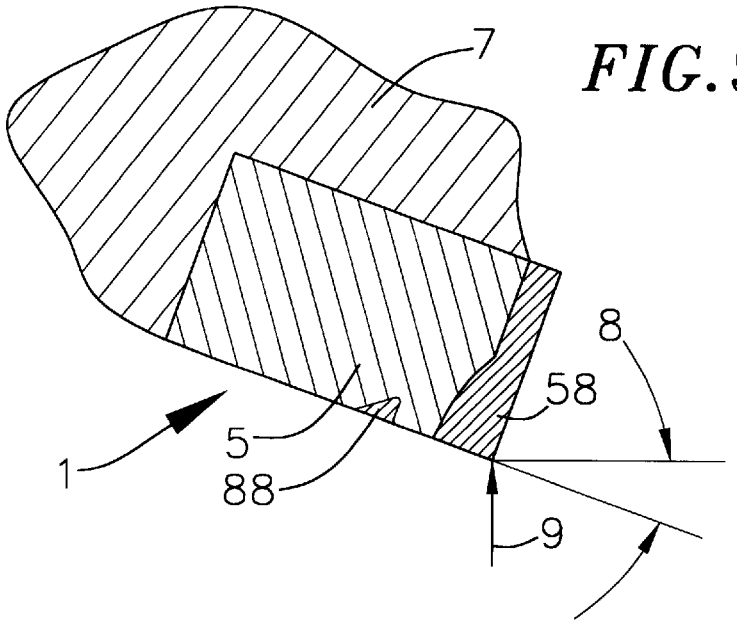
FIG. 9 is a cross-sectional view of a cutting element of the present invention mounted on a bit body.
Figure 2A:
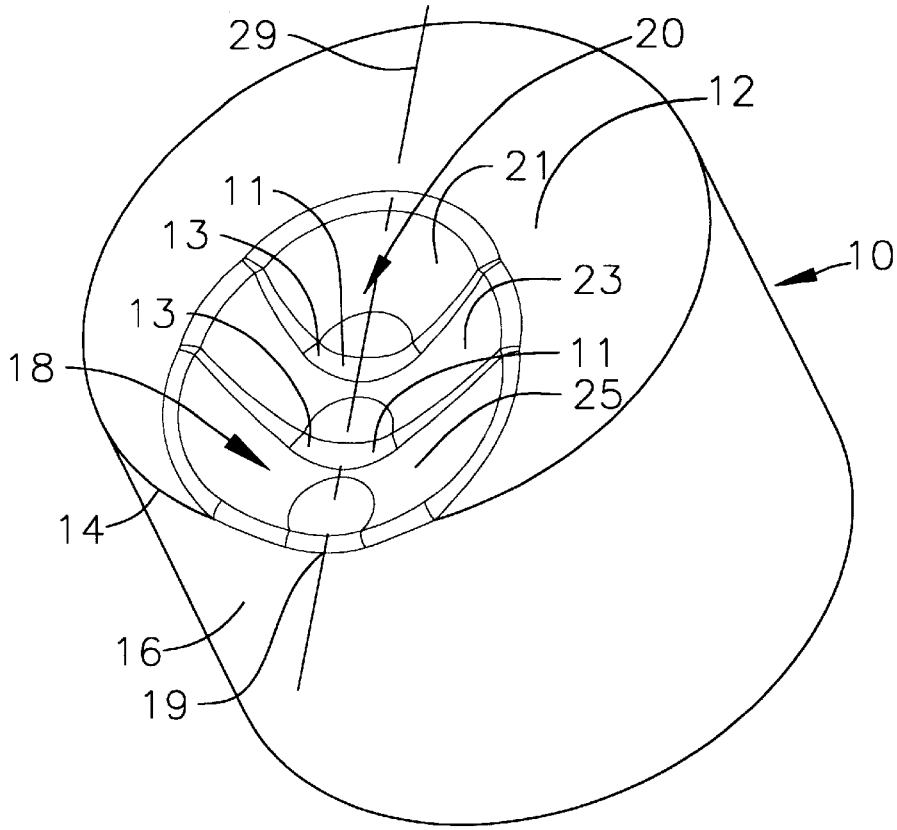
FIG. 2A is a perspective view of the body of an embodiment of an unplanar non-axisymmetric insert of the present invention.
Figure 2B:
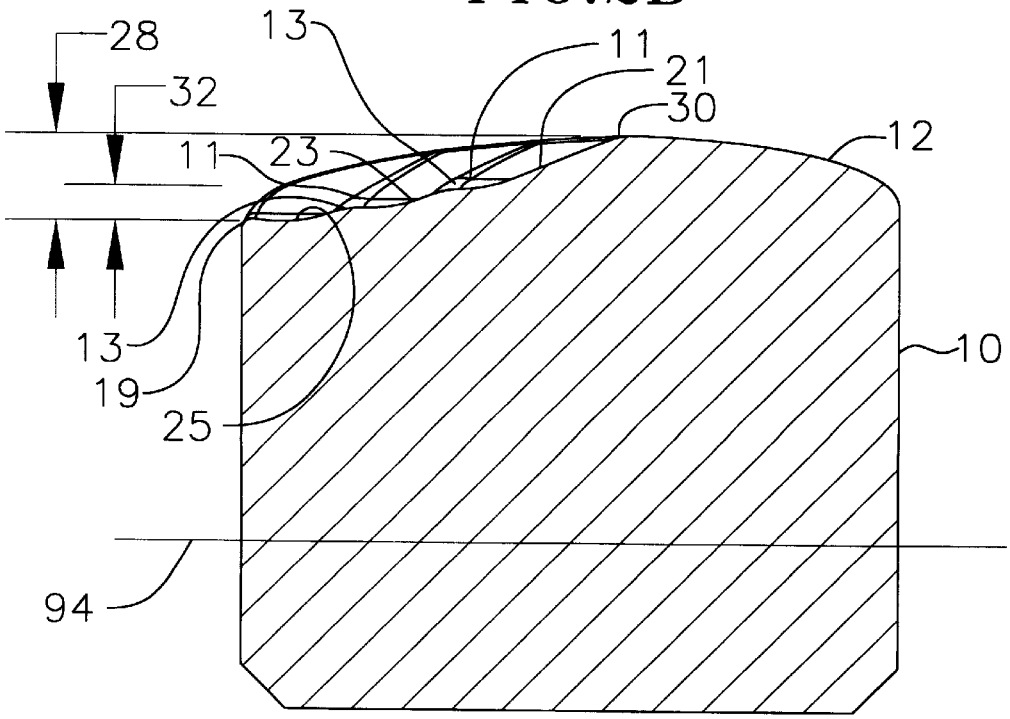
FIGS. 2B, 2C, and 2D are a cross-sectional view, a top view, and a front view, respectively of the insert body shown in FIG. 2A.
Figure 2C:
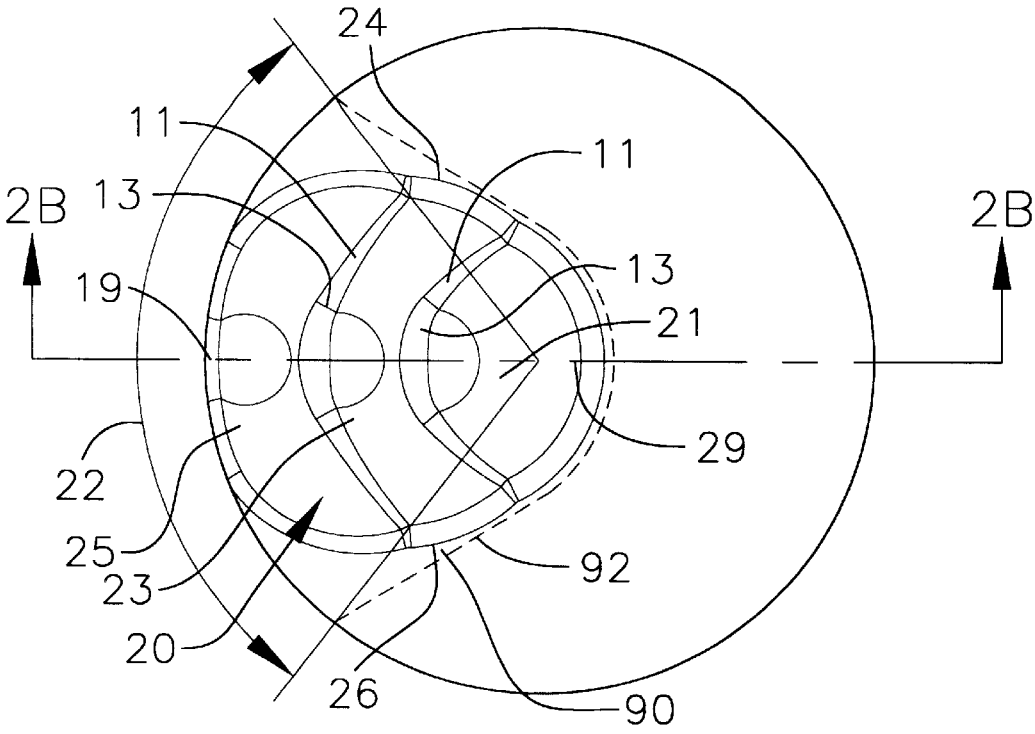
Figure 2D:
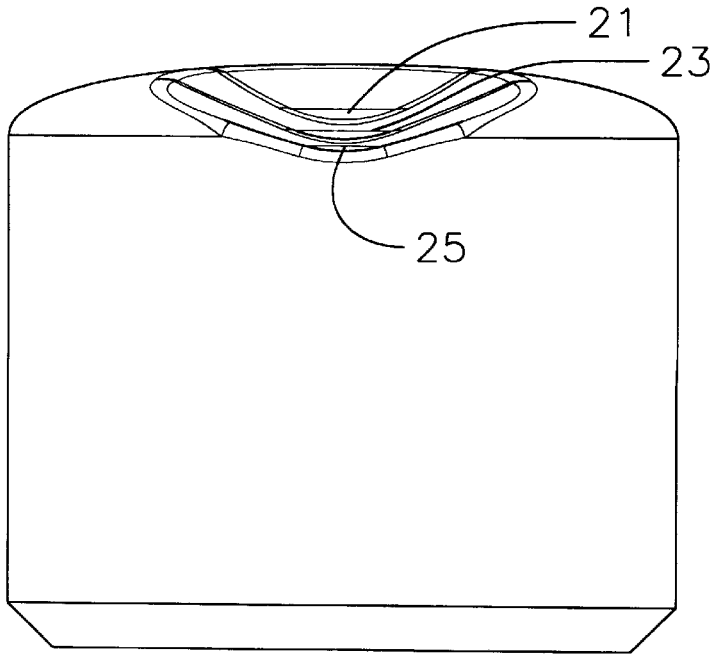
Figure 7A:
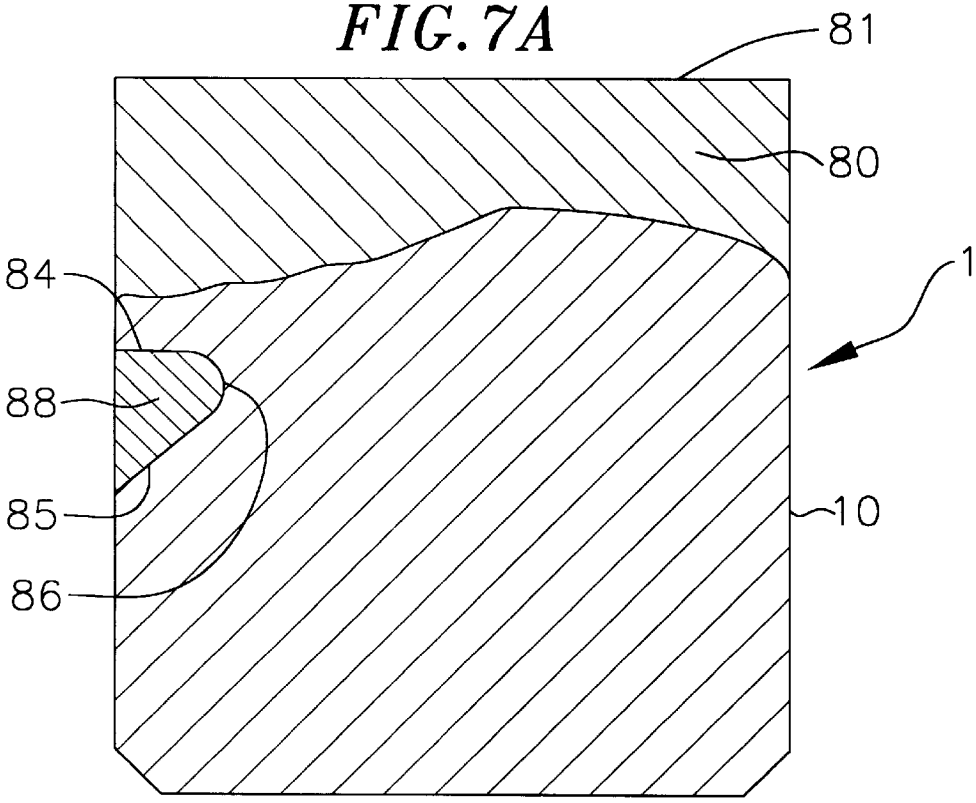
FIG. 7A is a cross-sectional view of an unplanar non-axisymmetric insert of the present invention having a primary cutting surface with a flat upper surface, and having a secondary cutting surface.
Figure 7B:
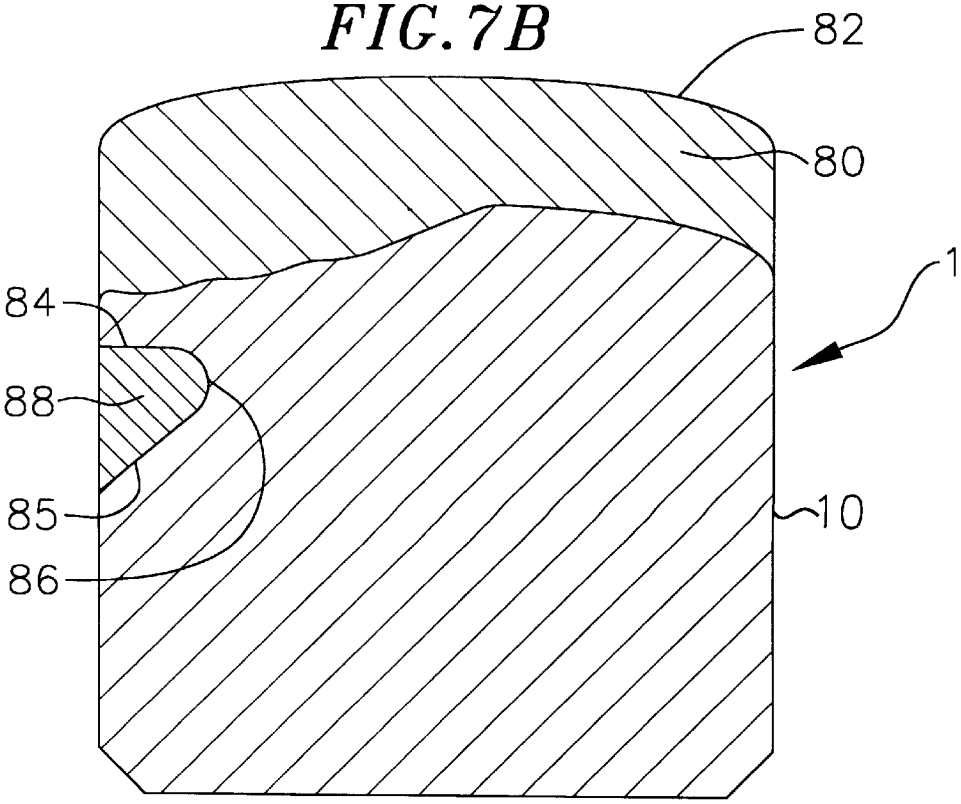
FIG. 7B is a cross-sectional view of an unplanar non-axisymmetric insert of the present invention having a primary cutting surface having a curved upper surface, and having a secondary cutting surface.
Figure 8:
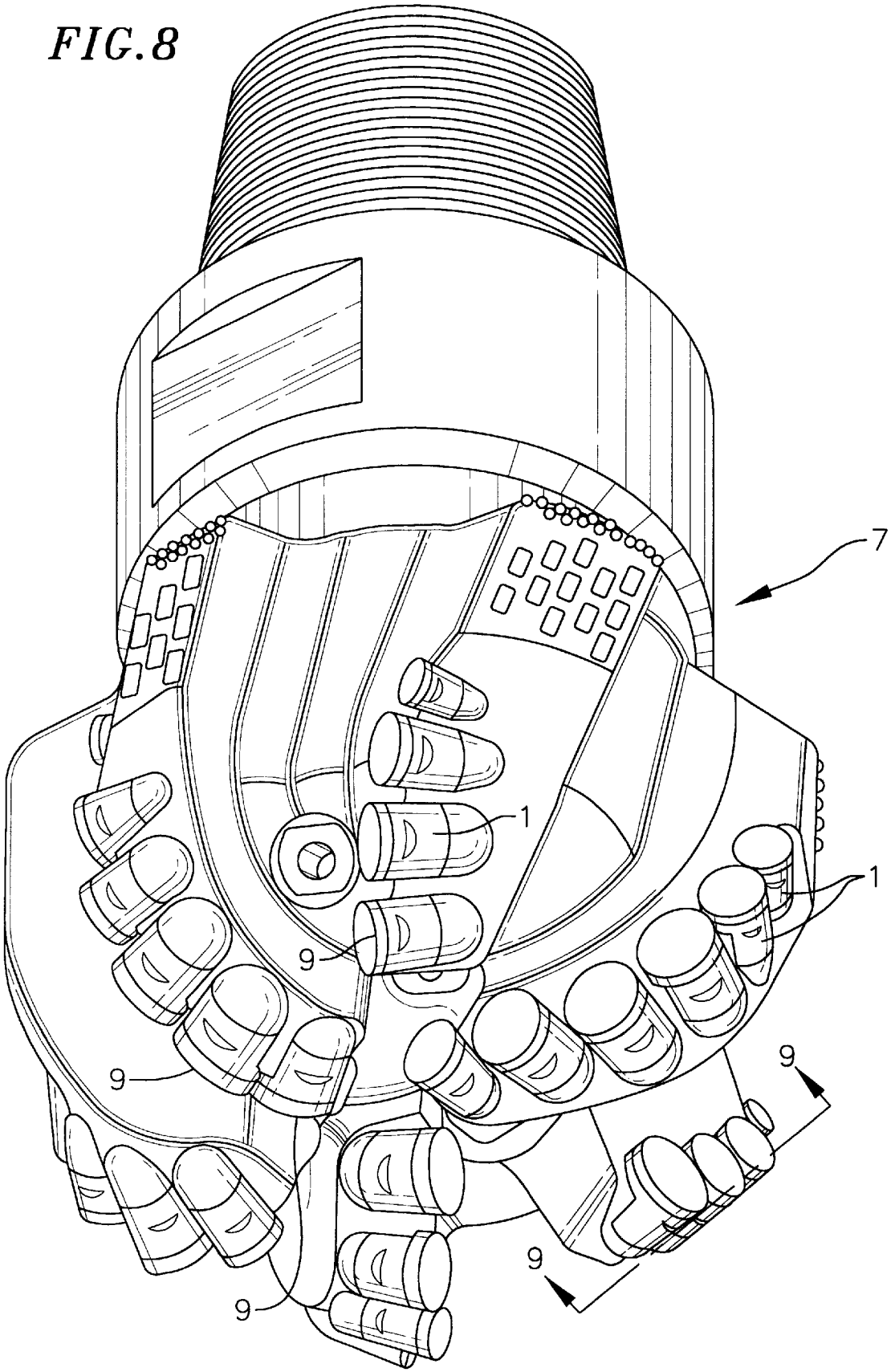
FIG. 8 is a perspective view of cutting elements of the present invention mounted on a bit body.

A present invention cutting element 1 (i.e., insert) has a body (i.e., a substrate) 10 having a curved upper surface 12 (FIGS. 9, 2A and 2B). The body is typically cylindrical. A circumferential edge 14 is formed at the interface of the curved upper surface 12 and the cylindrical outer surface 16 of the body. An ultra hard material layer such a polycrystalline diamond or cubic boron nitride layer 80 is formed on top of the upper surface (FIGS. 7A and 7B). The cutting elements 1 are mounted in a bit body 7 along a rake angle 8 (FIGS. 8 and 9). Consequently, the cutting layer 58 of each cutting element makes contact with the earth formation ideally at an edge point 9 referred to herein as the "cutting layer critical point". Similarly, the point on the body circumferential edge 14 axially below the cutting layer cricital point is referred to herein as the "body critical point" 19. To resist cracking, spoiling, chipping and partial fracturing, the present invention places an increased thickness of ultra hard material at a region 18 of cutting element which is subjected to the highest impact loads during drilling. This region, referred to herein as the "critical region" includes the body critical point 19. The critical region spans less than 50% of the circular cross-sectional area of the cutting element. Typically, however, the critical region spans an arc of about 45° to 70° on either side of the body critical point 19 and extend radially from the circumference of the cutting element inward to a location at or near the cutting element central axis and in many instance may extend over the central axis. A typical critical region 90 is shown bounded by dashed line 92 as shown in FIG. 2C. With the cutting elements of the present invention, the thickness of the ultra hard material cutting layer is increased where it is needed and minimized in other places so as to minimize the risk of cutting layer delamination and/or exfoliation.

To increase the thickness of the ultra hard material layer at the critical region, a main depression 20 is formed within the critical regions at the curved upper surface 12 (i.e., the end face) of the body that interfaces with the cutting ultra hard material cutting layer. The main depression is formed by forming a series of smaller adjacent depressions. For illustrative purposes, these smaller depressions are referred to herein as "secondary depressions". These adjacent secondary depressions can sometimes define steps. The main depression typically spans an arc less than 180° along the substrate upper surface. Preferably, however, the depression spans an arc 22 between 90° and 135° on the body upper surface (FIG. 2B). Because the critical region and the main depression spans only a portion of the insert body upper surface, and because the body upper surface is generally curved the body upper surface is unplanar and non-axisymmetric. Hence the cutting elements of the present invention are referred to as "unplanar non-axisymmetric inserts".

In one embodiment, the main depression is formed by a series of relatively shallow groove-like secondary depressions 21, 23, and 25 (FIGS. 2A–2D). The main depression 20 is ovoidal in shape. The secondary depressions are symmetric about a diameter 29. For descriptive purposes, the diameter is referred to herein as the "critical diameter." The critical diameter is the diameter that intersects the critical point 19. Each depression has a maximum actual depth 32—as measured between the highest and lowest point of the depression—occurring along the critical diameter. Each of the secondary depressions arcuately span the main depression defining scalloped edges 24 and 26 on the main depression as shown in FIG. 2C. Ridges 11 are formed between adjacent secondary depressions. The ridges 11 preferably have rounded apexes 13 to reduce stress concentrations. In this embodiment, the ridges 11 are arcuate curving toward the center of the insert. The curvature or radius of curvature of each ridge decreases for each subsequent radially outward ridge.

The depth 28 of each subsequent secondary depression—as measured from a reference point 30 on the substrate upper surface—is increased in a direction toward the body critical point 19 along the critical diameter 29 as shown in FIG. 2B. In other words, the height of the lowest surface of each subsequent secondary depression as measured from a reference plane 94 perpendicularly intersecting the body decreases radially outward along the critical diameter 29. In this regard, each secondary depression defines a step.

Figure 3A:
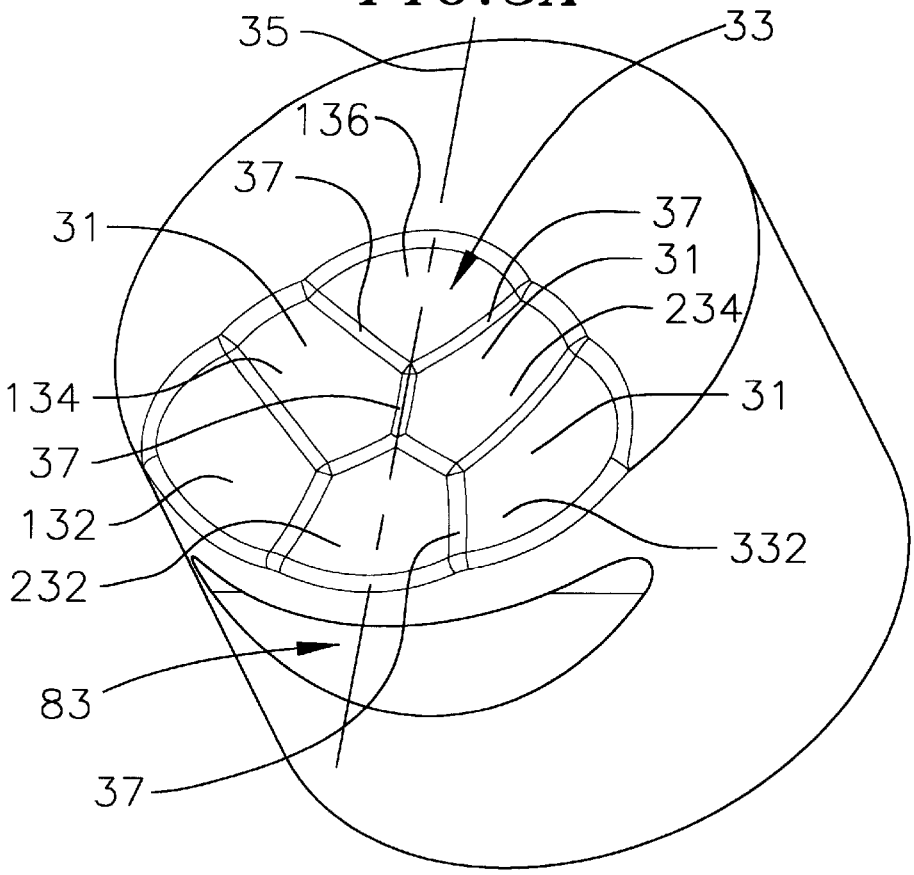
FIG. 3A is a perspective view of the substrate of another embodiment of an unplanar non-axisymmetric insert of the present invention.
Figure 3B:
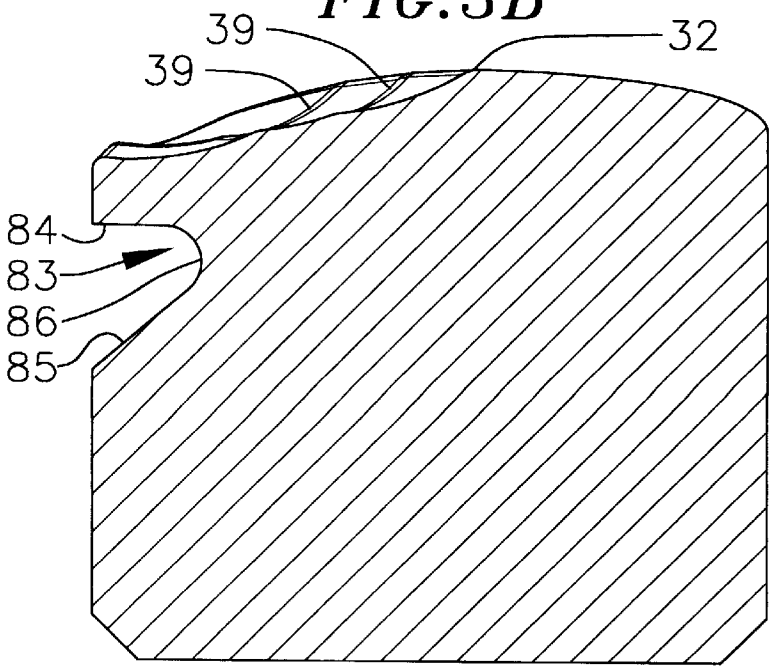
FIGS. 3B is a cross-sectional view of the insert body shown in FIG. 3A.

In another embodiment, the main depression 33 is generally triangular in shape (FIG. 3A). With this embodiment, the secondary depressions 31 are arranged in a pyramidal fashion defining a surface resembling the negative of a turtle shell. Three secondary depressions 132, 232, 332 are arranged along the circumferential edge of the insert body upper surface defining a first row of secondary depressions. A second row comprising two secondary depressions 134, 234 is formed adjacent to the first row of secondary depressions. Each of the second row secondary depressions is adjacent to two secondary depressions from the first row. A secondary depression 136 defines a third row. The third row secondary depression 136 is adjacent to both of the second row depressions 134, 234. In a preferred embodiment, the surface defined by the secondary depressions is symmetric about a critical diameter 35 of the insert body. Thus, in the preferred embodiment, the end depressions 132, 332 of the first row are mirror images of each other. Similarly the two second row depressions 134, 234 are also mirror images of each other, whereas the third row depression 136 and the middle depression 232 of the first row are both symmetric about the critical diameter. The maximum depth of the defined surface occurs along the critical diameter 35 with the first row middle depression 232 having a depth as measured from a point 32 on the upper surface of the body that is greater than the depth of the third row depression 136 as measured from the same point. The intersections between consecutive secondary depressions form ridges 37 which have preferably rounded apexes 39 so as to reduce stress concentrations (FIG. 3B).

Figure 4A:
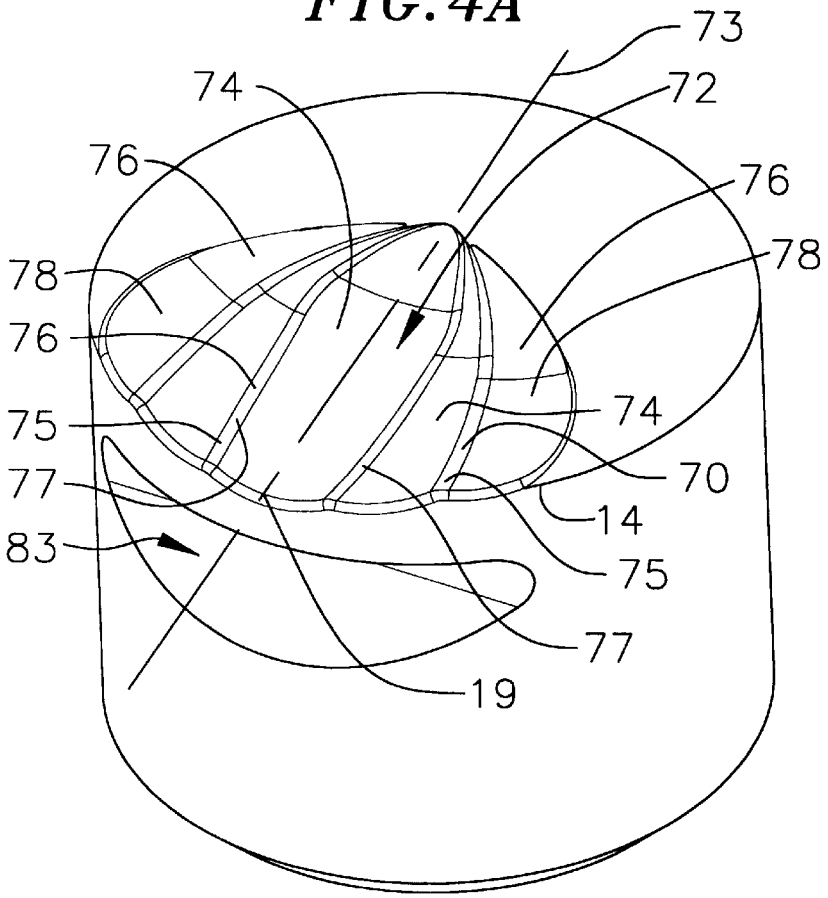
FIG. 4A is a perspective view of the substrate of another embodiment of an unplanar non-axisymmetric insert of the present invention.
Figure 4B:
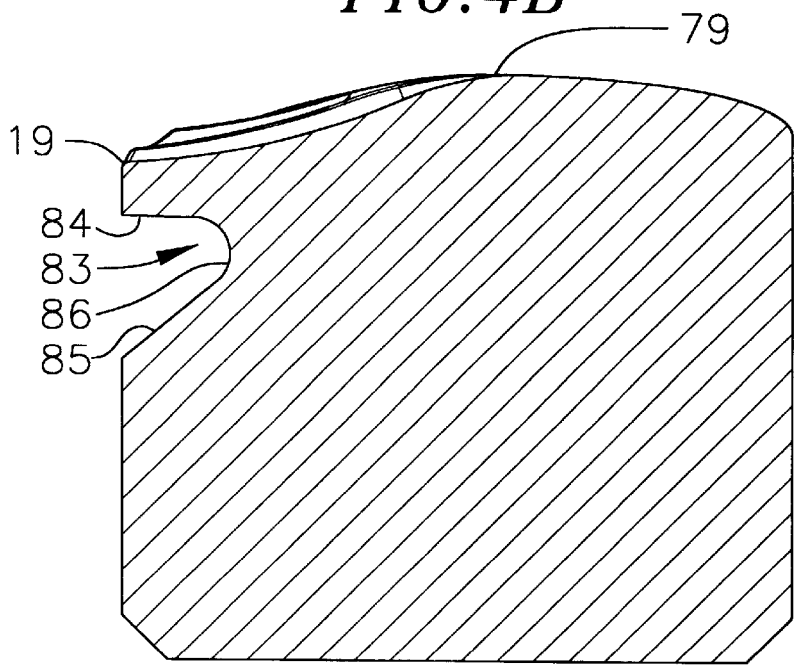
FIGS. 4B is a cross-sectional view of the insert body shown in FIG. 4A.

In another embodiment, the main depression 72 is formed by a series of generally radial secondary depressions 74 which preferably increase in depth—as measured from a reference point 79 on the substrate upper surface—in a direction toward the body circumferential edge 14 (FIGS. 4A and 4B). These depressions may be shaped and arranged to define a main depression surface that resembles the inner surface of a shell or that resembles a fan, as shown in FIG. 4A. Ridges 75 with preferably rounded apexes 77 are formed between adjacent secondary depressions. The main depression surface defined by the secondary depressions is symmetric about a critical diameter 73 of the insert body. Moreover, the maximum depth of the surface defined by the secondary depressions—as measured from a reference point 79 on the upper surface of the insert body—occurs at the body critical point 19. Furthermore, the maximum depth of each secondary depression decreases for depressions further away from the diameter. In addition, each radial secondary depression may itself consist of multiple steps or depressions, as for example steps 76 and 78 shown in FIG. 4A.

Figure 5A:
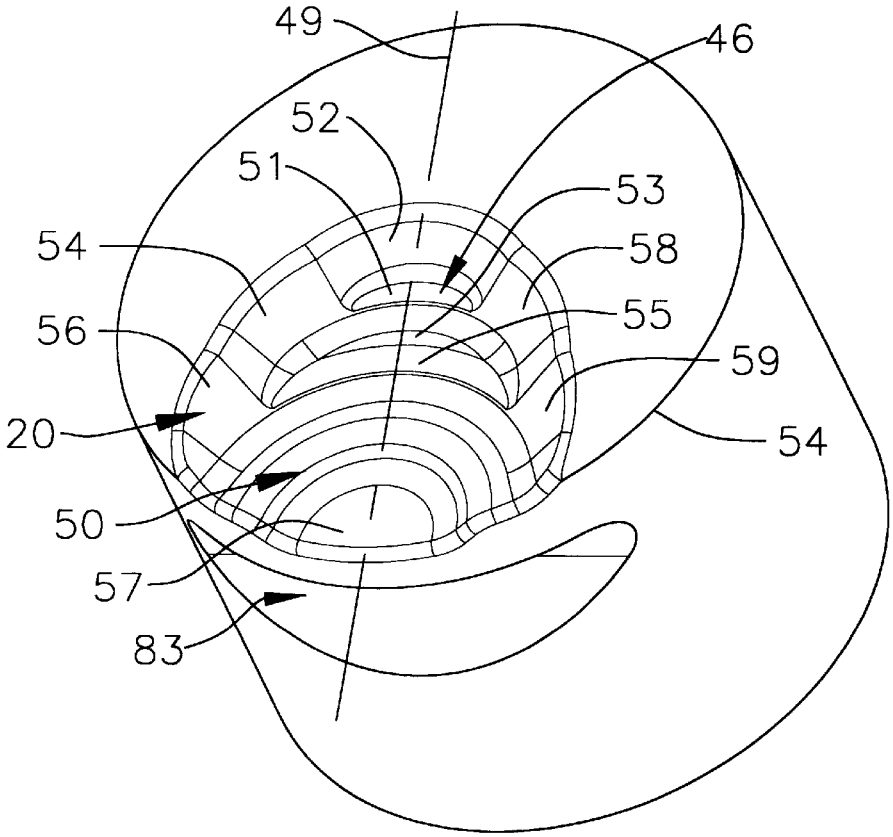
FIG. 5A is a perspective view of yet a further embodiment of the substrate of an unplanar non-axisymmetric insert of the present invention.
Figure 5B:
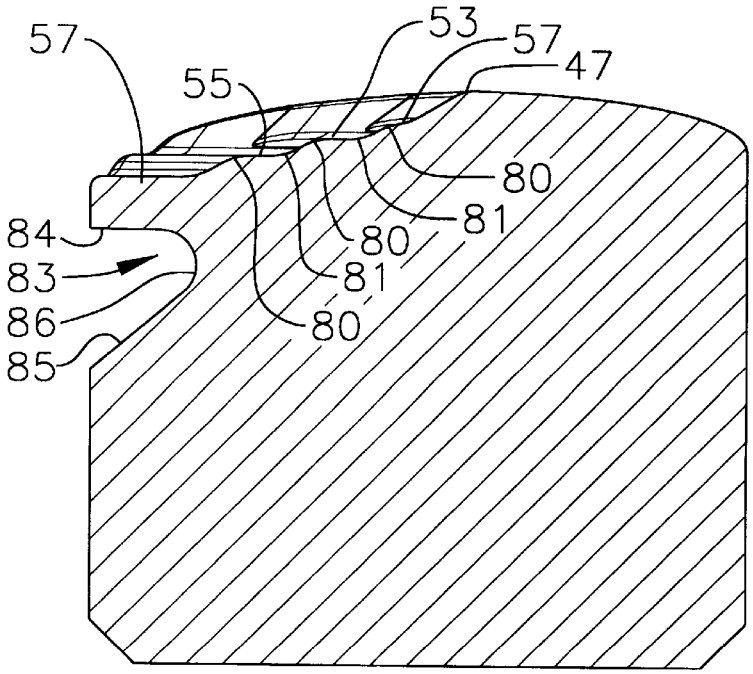
FIGS. 5B is a cross-sectional view of the insert body shown in FIG. 5A.

In yet another embodiment, the secondary depressions forming the main depression 50 comprise steps and concave walls. The steps and walls formed are arranged in a shape resembling a terrace or an amphitheater 46 which is symmetric about a critical diameter 49 as shown in FIGS. 5A and 5B. In this embodiment, of a series of arcuate steps 51, 53, 55, and 57 define the central part of the main depression as shown in FIGS. 5A and 5B. These steps define arcuate depressions which curve toward the body critical point 19.

The radius of curvature decreases for each subsequent radially outward arcuate step. The edges 80 of these steps and the edges 81 between steps are rounded to reduce stress concentration. A series of concave walls 52, 54, 56, 58 and 59 surround the arcuate depressions and extend to the periphery of the main depression 50. The maximum depth of each depression—as measured from a reference point 47 on the substrate upper surface—increases in a radially outward direction along the critical diameter 49. Moreover, the maximum depth of each depression occurs along the critical diameter 49.

Figure 6A:
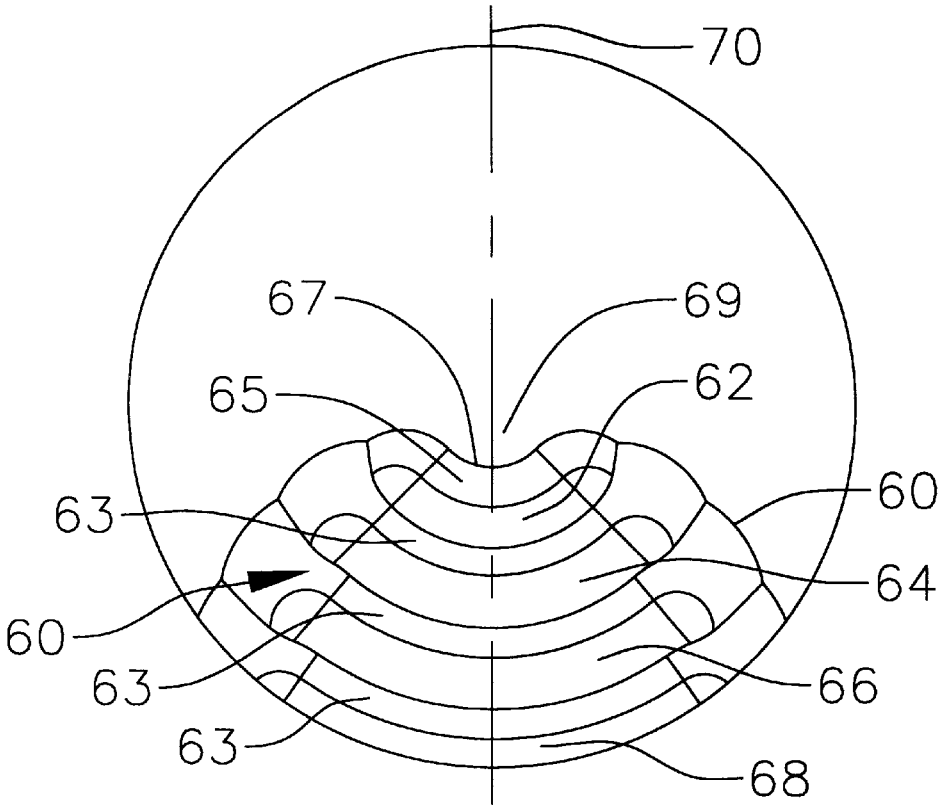
FIG. 6A is a top view of another embodiment of the substrate of an unplanar non-axisymmetric insert of the present invention.
Figure 6B:
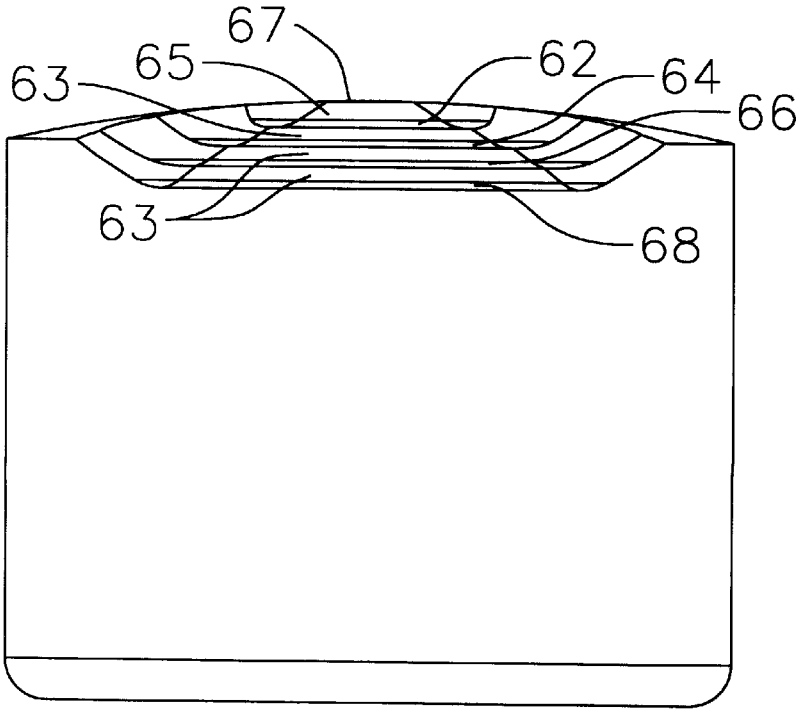
FIGS. 6B is a front view of the insert body shown in FIG. 6A.

In a further embodiment, the secondary depressions forming the main depression 60 comprise arcuate concave walls 63 and a series of arcuate steps 62, 64, 66 and 68 (FIGS. 6A and 6B). These steps define arcuate depressions which curve toward the center of the cutting element body. Each step is relatively flat. The radius of curvature decreases for each subsequent radially inward step. The main depression 60 does not extend to the central axis 69 of the cutting element. The arcuate concave walls 63 interconnect the subsequent steps and extend to the peripheral edges of the main depression 60. An arcuate concave wall 65 bounds the step 62 closest to the insert central axis. An edge 67 of the concave wall 65 curves around the central axis 69 of the substrate. The steps and walls are symmetric about a critical diameter 70. Moreover the depth of each subsequent step—as measured from a reference point on the upper surface of the body—increases for each subsequent radially outward step.

With all of the aforementioned embodiments, the periphery of the main depression which is defined by the secondary depressions, steps or walls, is scalloped. Moreover, the ultra hard material layer 58 bonded to the upper surface of the substrate may have a flat upper surface 81 (FIG. 7A) or may have a convexly curved or dome-shaped upper surface 82 (FIG. 7B), while the layer lower surface which interfaces with the substrate upper surface is complementary to the substrate upper surface. As such, an ultra hard material cutting layer is formed on top of the substrate having increased thickness at the critical region and a maximum thickness at the critical point of the cutting layer that will make contact with the earth formations during drilling. The maximum thickness of the ultra hard material cutting layer is preferably in the range of 0.08 to 0.12 inch. The minimum thickness of the ultra hard material layer is preferably in the range of 0.06 to 0.08 inch.

In all of the aforementioned embodiments, the multiple secondary depressions used to define the main depression provide for an non-planar interface between diamond cutting layer and the substrate in the critical region. This non-planar main depression provides for a larger bonding area between the ultra hard material and the body so as to reduce the stress levels at the interface which cause delamination. Consequently, a thicker ultra hard material cutting layer portion may be bonded at the critical region without increasing the risk of delamination of the cutting layer.

Furthermore, with any of these embodiments, a circumferential groove 83 may be formed on the cylindrical outer surface of the substrate in a location below the depression (FIGS. 3A, 3B, 4A, 4B, 5A, 5B, 7A, and 7B). Preferably, the groove spans an arc equal or slightly greater than the arc 22 span by the main depression on the upper surface of the substrate. In cross-section, preferably the groove has a horizontal upper side wall 84 and a slanted lower side wall 85 with a round bottom 86 therebetween. The slanted lower side wall slants in the direction opening the groove. The circumferential groove is preferably symmetric about a plane through the critical diameter. Applicant has discovered that the geometry of this groove reduces the level of the stresses generated at and around the groove. Moreover, the slanted wall of the groove provides for a groove geometry that is easier to pack with ultra hard material, thereby making the manufacture of the cutting clement easier and less costly.

Ultra hard material is bonded into the circumferential groove forming a secondary cutting surface 88. This secondary cutting surface serves two purposes. First it serves as an additional cutting surface, increasing the cutting efficiencies of the cutting element. Second, it delays the erosion and wear of the cutting element body that occurs when the cutting element body is allowed to make contact with the earth formation during drilling.

All of the inserts of the present invention are mounted in a bit body 7 and are oriented such that the critical region of each insert is positioned to engage the earth's formation at the critical point 9 of the cutting layer which will make contact with the earth formation during drilling (FIG. 8). In this regard, the region of high impact loading during cutting will have the thickest section of ultra hard material. Moreover, by doing so, the secondary cutting surface will also be aligned to eventually contact the earth formation and increases cutting efficiency as well as delay the erosion and wear of the cutting element.

What is claimed is:

1. A cutting element comprising:

a cylindrical body comprising an end face, a periphery, and a central axis;

a plurality of abutting secondary depressions formed on the end face defining a main depression, wherein the main depression spans less than half of the end face and extends to the periphery, and wherein the main depression is not axisymmetric about the central axis;

ridges formed at the intersection of the secondary abutting depressions wherein at least portions of the ridges are depressed relative to the end face; and an ultra hard material layer formed over the end face, wherein the thickness of the ultra hard material layer is greatest at the periphery of the end face above the main depression.

2. A cutting element as recited in claim 1 wherein the end face is convexly curved.

3. A cutting element as recited in claim 2 wherein the main depression comprises a periphery, wherein at least a portion of the main depression periphery is scalloped.

4. A cutting element as recited in claim 2 wherein the secondary depressions are pyramidally arranged forming a depressed surface having a generally triangular shape having a side along the body periphery.

5. A cutting element comprising:

a cylindrical body comprising a convexly curved end face and a periphery;

a plurality of abutting secondary depressions formed on the end face defining a main depression, wherein the main depression spans less than half of the end face and extends to the periphery;

ridges formed at the intersection of the secondary abutting depressions wherein at least portions of the ridges are depressed relative to the end face, and wherein the ridges comprise rounded apexes; and an ultra hard material layer formed over the end face, wherein the thickness of the ultra hard material layer is greatest at the periphery of the end face above the main depression.

6. A cutting element as recited in claim 5, wherein at least some of the abutting secondary depressions intersect a diameter of the end face, wherein one of said at least some secondary abutting depressions extends to the body periphery.

7. A cutting element as recited in claim 6 wherein the ridges formed between said at least some abutting secondary depressions comprise apexes intersecting said diameter, each of said apexes intersecting the diameter at a different height level as measured from a plane perpendicularly intersecting a central axis of the body, wherein said height levels decrease radially outward toward the body periphery.

8. A cutting element as recited in claim 6 wherein each secondary depression extends to a minimum height level as measured from a plane perpendicularly intersecting a central axis of the body, wherein said height level decreases arcuately away from said diameter.

9. A cutting element as recited in claim 6 wherein the main depression is symmetric about the diameter.

10. A cutting element as recited in claim 6 wherein a portion of each of the ridges intersecting the diameter bend toward the center of the body forming a curve.

11. A cutting element as recited in claim 10 wherein each of the portions of the ridges has a radius of curvature, wherein the radius of curvature decreases for each radially inward ridge portion.

12. A cutting element as recited in claim 6 wherein a portion of each of the ridges intersecting the diameter bend toward the periphery forming a curve.

13. A cutting element as recited in claim 12 wherein each of the portions of the ridges has a radius of curvature, wherein the radius of curvature decreases for each radially outward ridge portion.

14. A cutting element as recited in claim 12 wherein the main depression comprises a periphery, wherein some of the secondary depressions define arcuate walls extending from the periphery of the main depression and abutting said at least some abutting secondary depressions intersecting said diameter.

15. A cutting element comprising:

a cylindrical body comprising a convexly curved end face and a periphery;

a plurality of abutting secondary depressions formed on the end face defining a main depression, wherein the main depression spans less than half of the end face and extends to the periphery;

ridges formed at the intersection of the secondary abutting depressions wherein at least portions of the ridges are depressed relative to the end face, and wherein the at least some secondary abutting depressions extend in a generally radial direction forming generally radial ridges there between; and an ultra hard material layer formed over the end face, wherein the thickness of the ultra hard material layer is greatest at the periphery of the end face above the main depression.

16. A cutting element as recited in claim 15 wherein the radial ridges have rounded apexes.

17. A cutting element as recited in claim 16 wherein each of the generally radial ridges comprises an apex having a height level which decreases in a generally radially outward direction.

18. A cutting element as recited in claim 16 wherein said secondary depressions include depressions on either side of a body diameter, wherein each secondary depression comprises a surface extending to a height level as measured from a plane perpendicularly intersecting a central axis of the body, wherein the height level of each secondary depression as measured along a radial arc increases for each depression further away from said diameter.

19. A cutting element as recited in claim 18 further comprising a secondary depression extending along the diameter and having a surface extending to a height level lower than the height levels of all other secondary depressions.

20. A cutting element as recited in claim 18 wherein the main depression is symmetric about the diameter.

21. A cutting element comprising:

a cylindrical body comprising a convexly curved end face and a periphery;

a plurality of abutting secondary depressions formed on the end face defining a main depression, wherein the main depression spans less than half of the end face and extends to the periphery, wherein the secondary depressions are pyramidally arranged forming a depressed surface having a generally triangular shape having a side alone the body periphery, and wherein the plurality of abutting secondary depressions comprise, three abutting secondary depressions along the body periphery forming a first row of secondary depressions, two abutting secondary depressions forming a second row of secondary depressions, each of the second row depressions abutting two of the first row depressions, and one secondary depression abutting both second row depressions;

ridges formed at the intersection of the secondary abutting depressions wherein at least portions of the ridges are depressed relative to the end face; and an ultra hard material layer formed over the end face, wherein the thickness of the ultra hard material layer is greatest at the periphery of the end face above the main depression.

22. A cutting element as recited in claim 21 wherein the ridges formed between abutting secondary depressions have rounded apexes.

23. A cutting element as recited in claim 21 wherein each of said apex has a height as measured from a plane perpendicularly intersecting the body, wherein the apex heights decrease along any radius.

24. A cutting element as recited in claim 21 comprising a radius along the ridge formed between the two second row depressions, wherein each of the ridges has a height, wherein the ridge heights as measured from a plane perpendicular intersecting a central axis of the body increase along an arc on either side of the radius.

25. A cutting element as recited in claim 24 wherein the main depression is symmetric about the radius.

26. A cutting element as recited in claim 25 wherein the ultra hard material layer comprises a first surface interfacing with the end face and a second surface opposite the opposite the first surface, wherein the second surface is flat.

27. A cutting element as recited in claim 25 wherein the ultra hard material layer comprises a first surface interfacing with the end face and a second surface opposite the opposite the first surface, wherein the second surface is convexly curved.

28. A cutting element comprising:

a cylindrical body comprising an end face, and a periphery;

a plurality of abutting secondary depressions formed on the end face defining a main depression, wherein the main depression spans less than half of the end face and extends to the periphery;

ridges formed at the intersection of the secondary abutting depressions wherein at least portions of the ridges are depressed relative to the end face;

an ultra hard material layer formed over the end face, wherein the thickness of the ultra hard material layer is greatest at the periphery of the end face above the main depression;

a circumferential groove formed on the body below the primary depression; and ultra hard material within the groove.

29. A cutting element as recited in claim 28 wherein the circumferential groove comprises:

a first surface;

a second surface further from the main depression than the first surface and opposite the first surface; and a concave surface joining the first and second surfaces, forming a groove having a concave bottom wherein the second surface is concave along its length.

30. A cutting element as recited in claim 29 wherein the first surface is relatively horizontal and wherein the second surface slopes away from the first surface in an outward direction.

31. A cutting element as recited in claim 30 wherein the groove spans only a portion of the circumference.

32. A cutting element as recited in claim 31 wherein the groove comprises a first and a second end and wherein the groove has a width as measured axially along the outer surface of the body, wherein said width is minimum at the first and second ends and maximum at about the groove mid length.

33. A cutting element comprising:

a cylindrical body comprising an end face, a periphery, and a central axis;

a plurality of steps formed on the end face;

a plurality of wall surfaces formed on the end face, wherein the plurality of steps and wall surfaces define a main depression spanning less than half of the end face and extending to the periphery, wherein the main depression is not axisymmetric about the body central axis; and an ultra hard material layer formed over the end face, wherein the thickness of the ultra hard material layer is greatest at the periphery of the end face above the main depression.

34. A cutting element as recited in claim 33 wherein the steps curve in a direction toward the center of the cutting element body.

35. A cutting element as recited in claim 33 wherein the plurality of wall surfaces are concave.

36. A cutting element as recited in claim 33 wherein the main depression has a scalloped periphery.

37. A cutting element comprising:

a cylindrical body comprising an end face and a periphery;

a plurality of steps formed on the end face;

a plurality of wall surfaces formed on the end face, wherein the plurality of steps and wall surfaces define a main depression spanning less than half of the end face and extending to the periphery;

an ultra hard material layer formed over the end face, wherein the thickness of the ultra hard material layer is greatest at the periphery of the end face above the main depression;

a circumferential groove formed on the body comprising, a first relatively horizontal surface, and a second surface opposite the first surface, the second surface being further from the main depression than the first surface and sloping away from the first surface in an outward direction; and ultra-hard material in the groove.

* * * * *

UNITED STATES PATENT AND TRADEMARK OFFICE

CERTIFICATE OF CORRECTION

PATENT NO. : 6,244,365 B1
DATED : June 12, 2001
INVENTOR(S) : Stephen G. Southland It is certified that error appears in the above-identified patent and that said Letters Patent is hereby corrected as shown below:

Title page,
Item [56], References Cited, U.S. PATENT DOCUMENTS, replace "5,564,551 10/1996 Frushour ….175/431" with -- 5,564,511 10/1996 Frushour ….175/431 --.

Column 1,
Line 19, replace "on to" with -- onto --.

Column 2,
Line 7, replace "are" with -- arc --.
Line 28, replace "FIGS. 3B" with -- FIG. 3B --.
Line 34, replace "FIGS. 4B" with -- FIG. 4B --.
Line 39, replace "FIGS. 5B" with -- FIG. 5B --.
Line 44, replace "FIGS. 6B" with -- FIG. 6B --.

Column 3,
Line 1, replace "such a" with -- such as --.
Line 19, replace "extend" with -- extends --.
Line 21, replace "instance" with -- instances --.

Column 5,
Line 48, replace "an non-planar" with -- a non-planar --.

Column 6,
Line 5, replace "clement" with -- element --.

Column 7,
Line 52, replace "there between" with -- therebetween --.

Column 8,
Line 21, replace "alone" with -- along --.
Line 42, replace "claim 21" with -- claim 22 --.
Line 45, after "radius" insert -- in a radially outward direction --.

UNITED STATES PATENT AND TRADEMARK OFFICE

CERTIFICATE OF CORRECTION

PATENT NO. : 6,244,365 B1
DATED : June 12, 2001
INVENTOR(S) : Stephen G. Southland It is certified that error appears in the above-identified patent and that said Letters Patent is hereby corrected as shown below:

Column 8 cont'd,
Lines 56-57, delete "opposite the" (second occurrence).
Lines 60-61, delete "opposite the" (second occurrence).

Signed and Sealed this

Twenty-second Day of October, 2002

*Attest:*

*Attesting Officer*

JAMES E. ROGAN
*Director of the United States Patent and Trademark Office*